US005870797A

United States Patent [19]

Anderson

[11] Patent Number: 5,870,797

[45] Date of Patent: Feb. 16, 1999

[54] VACUUM CLEANING SYSTEM

[76] Inventor: Kent George Anderson, 925 N. Griffin, Bismarck, N. Dak. 58501

[21] Appl. No.: 801,064

[22] Filed: Feb. 14, 1997

Related U.S. Application Data

[60] Provisional application No. 60/012,174 Feb. 23, 1996.

[51] Int. Cl.[6] ..... A47L 5/38

[52] U.S. Cl. ..... 15/301; 15/310; 15/393

[58] Field of Search ..... 15/301, 310, 311

[56] References Cited

U.S. PATENT DOCUMENTS

| | | | |
|---|---|---|---|
| 2,599,049 | 6/1952 | Dollinger | 15/301 |
| 2,953,805 | 9/1960 | Sevenich | 15/310 |
| 3,064,298 | 11/1962 | Jones | 15/310 |
| 3,165,773 | 1/1965 | Palpacelli | 15/310 |
| 3,786,531 | 1/1974 | Borg | 15/310 |
| 4,027,355 | 6/1977 | Mead et al. | 15/310 |
| 4,951,345 | 8/1990 | Nappi | 15/311 X |

FOREIGN PATENT DOCUMENTS

| | | | |
|---|---|---|---|
| 2108848 | 5/1972 | France | 15/310 |
| 2034796 | 6/1980 | United Kingdom | 15/301 |

*Primary Examiner*—Chris K. Moore

[57] ABSTRACT

The essential cleaning system components for a best mode are as follows. A textile fabric covering of an article has a pile and a backing. A vacuum mat is added below the fabric covering to aid in the flow of dirt and debris from the pile of the covering. A secondary backing is also added for supporting the vacuum mat. A support platform located below the vacuum mat receives the dirt and debris through openings of the support platform. The dirt and debris is transported through channels in the support platform to a collection device. The collection device is equipped with a slider device within the collection device for maintaining adequate suction in the cleaning system. A vacuum unit pulls dirt and debris from the collection device through a vacuum line and discharges it into the discharge container. After cleaning the dirt and debris from the air it is discharged to the atmosphere.

20 Claims, 6 Drawing Sheets

VACUUM CLEANING SYSTEM

This application claims benefit of provisional application WO/012,174 filed Feb. 23, 1996.

BACKGROUND OF THE INVENTION

This invention relates to a system for cleaning carpets, rugs, upholstery and like articles, and in particular it relates to a system where the article is able to clean itself by forcing dirt and debris down under the surface of the article for removal. In addition, a the article can be cleaned by a cleaning fluid forced into the article prior to sucking the dirt and debris downand out, thus saving time and making it easier for cleaning articles.

Vacuum cleaners have been used since 1900. There have been numerous vacuum cleaners sold on the open market. They have been generally in two types, canister and upright. A canister vacuum cleaner contains a powerful suction fan for pulling dirt up and out of the carpet surface into a rotating agitator unit, through a flexible hose and into a bag within a canister. The upright vacuum cleaner generally has a smaller suction fan and the agitator is in the base unit with a larger bag directly above the base unit. Waste material is also sucked up and out of the article into the larger bag attached to a handle of the upright vacuum cleaner. Upright vacuum cleaners are generally used for cleaning floors having carpets. An agitator is generally a rotating cylinder with bristles that loosen the dirt from within the article to be picked up and out from the surface of the article into the bag. There are a number of other type vacuum cleaners including light weight hand held units for upholstery and heavy duty shop vacuuming systems for picking up loose material in a shop. Wet vacuum systems allow water to be picked up along with the dirt and debris, and for example, are very useful after an article has been steam cleaned.

Vacuum cleaning units are most useful with carpets in a business office and in the home. The different kinds of carpets include area rugs, carpeted walls and other thick woven fabric articles which add texture, comfort and beauty to the decor. Rugs are referred to herein as being loose from the floor as opposed to carpets which are attached to the floor. Carpets can be made in a variety of textures, sizes and patterns to enhance the environment. Most carpeting is purchased from 12 or 15 foot wide rolls. Area rugs are generally rectangular in shape made in standard sizes from about 4 feet by 6 feet to about 9 feet by 12 feet.

In general there are two main parts of the carpet which are the thick pile adjacent the top surface and the backing at the bottom to give the carpet lateral strength and stability. The pile of a carpet is woven into a web like primary backing to form the carpet. Typical materials used for both the top pile and bottom backing include olefin, jute, linen, rayon, and cotton. Blends of these materials are also common. Many synthetic materials are also used in the pile including nylon, synthetic polyamide and polyester. Three different weaves used in making carpet are: (1) a velvet, which is the simplest type where almost all the pile yarn appears on the top surface of the carpet resulting from the commonly known chain wrap or stuffer wrap process; (2) a wilton, which has all its pile yarn running in rows along the backing and raised to the surface; and (3) the axminster, which has a chain wrap or weft stuffer wrap process where each pile yarn is inserted independently with most of the pile appearing near the surface of the carpet.

The pile of the carpet is woven to have a pile density to support foot traffic without crushing. The pile density should also be thick enough to not see the backing and to maintain the same appearance new as it is when worn. In general, the higher the pile density the better. However, this results in a pile that is very difficult to clean. The dirt and debris settles down toward the backing and is very difficult to pull up and out of the thick pile.

The need continues to provide a system for the cleaning of articles including carpets, rugs and upholstery which is more efficient, easier to do and less time consuming. The need exists for cleaning a carpet where it is difficult to pull dirt and debris up and out of the carpet. For example, in areas not accessible under furniture and for surfaces which are not shaped like the cleaning head of a vacuum cleaner.

To meet the needs and solve the problems outlined above an object of the present invention is to provide a system for cleaning articles having a textile fabric covering including carpets, rugs, upholstery and the like in an easier way. In particular, the object is to provide a means for cleaning articles by vacuuming from below the primary backing. The object is to created a vacuum under the surface which will make the article cleaner and save time required for cleaning.

Another object of the invention is to provide a system for cleaning the fabric covering of an article using a cleaning fluid or water. For example, the cleaning system should be able to steam clean a carpet. The system is to include a plurality of channels and/or tubes with openings such as nozzles, valves, slots and the like wherein a fluid can flow in both directions; to spray (liquid) into an article then to vacuum (air) from the article. For example, even the pile of a carpet can be made to interface with the channels and/or tubes. System components can be made to be incorporated under the primary backing of the carpet or intertwined within the pile of the carpet. The object is to clean an area by flushing the area with a liquid cleaner or water through the channels or tubes, then reversing the flow to vacuum the area with dry air.

Yet another object of the invention is to provide a cleaning system capable of different applications and uses. The cleaning system can be incorporated under carpets or rugs, as a base portion of a cushion, or installed as a vacuuming foot scraper at the entrance of a building. Exposed components of the cleaning system can be made to look like the article they are being used with.

A further object of this invention is to have a cleaning system which can be made separate from the article to be cleaned. The object is to provide a cleaning system formed as a flat surface with many openings or holes to be placed under an article to correspond with holes in a base portion of the fabric covering. The object is to have holes in the flat surface that can be made to correspond with holes in a loosely woven backing of the fabric covering of an article. When placing the cleaning system under a cushion, for example, the cushion would need to have openings in its primary backing. The weave of the cushion covering must be loosely strung so the dirt and debris can be sucked out from the underside of the cushion. Suction can be maintained for large articles by selectively aligning holes in the flat surface to receive a vacuuming force until the whole article is cleaned.

In yet another object of the present invention a vacuum unit with filters is to be an integral part of the cleaning system. The vacuum unit can be associated with the article itself to suck dirt and debris into the vacuum unit from under the article. The object is to make the cleaning system, including the vacuum unit, become a part of an upholstered article of furniture, a part of the floor construction under the carpet of a house, or other similar applications.

SUMMARY OF THE INVENTION

The above objects are accomplished according to the present invention by the cleaning system herein disclosed and described. The cleaning system is made to have many uses and applications to save time with easy cleaning of articles. The cleaning system is generally considered to be made as an associated part of the article being cleaned. The need for a portable vacuum cleaner to clean the article will be eliminated. The article is made to clean itself. The components can be made to look like the article they are used with. The components of the cleaning system also can be made in different sizes, shapes and colors to function as a cleaning system to fit the decor or to be hidden from view. The cleaning system can be made in different ways. It can be made as part of the article or a separate system placed near an article. Components of the cleaning system can serve as additional padding for a cushion or as a backing pad for a carpet. The essential components of the cleaning system are individually discussed in detail in the following summary.

One essential component of the cleaning system is the vacuum mat. The vacuum mat can be made to look like an article. For example, the vacuum mat can be made as a separate cushion for upholstered furniture or can be woven into a cushion or carpet as part of the carpet base or backing. The vacuum mat can be integrated with the pile of a carpet to assist the pile in providing enhanced means for sucking dirt down into the vacuum mat. The pile and weave used with a carpet or cushion will actually be a part of the subject material of the invention. The vacuum mat can be incorporated during the tufting process as part of the carpet. The vacuum mat can be made with the same materials as used in making a carpet. For example, the vacuum mat can be incorporated in the carpet by being made in between a primary backing of the carpet and a secondary backing of the vacuum mat.

The vacuum mat can also consist of flexible tubing having openings with nozzles or valves that allow the flow of liquid into the carpet pile during cleaning as well as the flow of laden air and liquid sucked from the carpet pile. Components of the vacuum mat may include tubes with small sprayers or nozzles being openings which can discharge water up into a pile of the carpet and then the soiled water can be sucked out of the pile through the same tube openings. The pile of the carpet would interface with these many openings of the vacuum mat. In the vacuum mat there can be many lines or tubes of various sizes that are hooked together into larger line or tubes, and so on to interface with other components to be discussed. The edges of the carpet can be made to terminate these openings so that suction can be sustained in the lines or tubes of the vacuum mat and laden air can be drawn through the carpet pile and vacuum mat to an area below or to one side of the vacuum mat.

The vacuum mat should be able to support the weight of foot traffic or a person setting on the article without crushing. The vacuum mat should be made thick enough to accommodate the means for cleaning and vacuuming operations, but thin enough for conserving the total space required below the article when used with the other components of the cleaning system of this invention.

Alternately, the vacuum mat can be simply a thin structure provided with openings to allow dirt and debris to fall below the vacuum mat and be sucked from an area below the vacuum mat. For example, the vacuum mat can be similar to the backing of a carpet which has been woven to have an loose structure that provides openings for dirt and debris to pass downward through the carpet. Many carpets have a backing which has a latex coating to close the holes in the backing and give it stability and strength. The vacuum mat can be as simple as the same standard backing with no latex coating. For example, the vacuum mat can replace the primary backing of a carpet.

A preferred component of the cleaning system is a structural platform placed below the vacuum mat. The vacuum mat can be used alone, if a means for removing dirt and debris from tubular components within the mat is realized. However, removal by using a support platform is much more practical. The support platform comprises a plurality of channels formed within the platform. The support platform structure must be strong enough to support surface loads but open enough to allow dirt and debris to be drawn down from the vacuum mat into the channels of the support platform. The support platform has a series or openings or perforations on the top to receive dirt and debris from the vacuum mat into the channels. The walls of the channels are made of a material that will withstand the loads applied to the surface of the article as well as the internal pressure or suction within the channels. For example, a series of tubular components or plastic tubes can be used to form the structural platform for the cleaning system. The vacuum platform can also be made like a frame having thin top and bottom faces and vertical web members between the faces.

Elongated channels in the structural platform are made air tight along their length except for an end opening and perforations provided in the top surface of the structural platform to receive the dirt and debris suspended in the air from cleaning an article. These openings are made to align themselves with the openings or tubes coming from the vacuum mat. When openings are aligned between the channels and the mat, dirt and debris will be sucked by a flow of air into the channels formed in the platform. The platform can be made with a sliding component to selectively align with end openings in the channels of the support platform with openings in the sliding component to maintain suction in the channels of the support platform. Means for aligning corresponding openings are provided by the sliding component of the support platform which is discussed in more detail in the embodiments of the best mode. A cleaning fluid can be forced up into the article through the openings in the support platform for cleaning the article before it is sucked dry.

All of the internal channels in the structural platform terminate in a vacuum chamber. More than one vacuum chamber can be used, but preferably there is one vacuum chamber along one side of the support platform. The vacuum chamber is preferably included as part of the support platform. The vacuum chamber has an outlet for attaching a flexible hose to the chamber to remove dirt and debris from the chamber. The same hose, or a separate hose, can be used for injecting a cleaning fluid into the vacuum chamber and further into the vacuum mat and then into the article to be cleaned.

As with any vacuum cleaning system, another essential component is the vacuum unit for providing suction to clean the article of dirt and debris. The vacuum unit can be made as an integral component of the cleaning system or as a separate unit connected to the vacuum chamber of the support platform by a flexible vacuum line. The vacuum unit can be attached to a structural component of a building or built into the building structure. For example, the vacuum unit can be attached to the wall of a building or built into the wall.

Cleaning the article is accomplished by providing a cleaning unit to interface with the vacuum unit. The cleaning unit includes a pump and reservoir for the cleaning fluid. The cleaning unit simply forces the cleaning fluid through the same openings in the support platform and vacuum mat as used for vacuuming the article. The cleaning unit can include a separate system of tubes or may use the same vacuum chamber and channels of the support platform. The cleaning system can be made to steam clean the article by the cleaning unit having a heating element for forcing hot water through the vacuum mat. The soiled water would be sucked into a wet vacuum container using the vacuum unit. The ability of the cleaning system to self-clean articles makes it also useful in shops, manufacturing environments and power plants; as well as in the home. Again, the cleaning system can be installed to become an associated part of the article it is used with; as the means to make the cleaning system operate are unique to this invention.

The cleaning system can keep itself as well as an article clean by the cleaning unit flushing out the system as needed. The vacuum unit can operate as a wet vacuum to suck the article and the cleaning system dry after being cleaned. Alternately, the article and the cleaning system can be filed with a cleaning fluid, using the cleaning unit, and a drain can be provided within the support platform. When the cleaning fluid has finished cleaning the article the fluid can be made to flow freely out the drain, without the use of a vacuum unit or in addition to the use of a vacuum unit.

Another essential component of this cleaning system is the discharge container that retains the dirt and debris from cleaning an article. The discharge container has an inlet which interfaces directly with an outlet of the vacuum unit. The discharge container can be made of a metal or a plastic material. The desired filters are also provided as part of the discharge container for cleaning the air of dirt and debris before it is discharged into the atmosphere at a discharge outlet. The discharge container also retains any cleaning fluid used to clean the article when the vacuum unit is used during a wet vacuuming operation. Filters may be of any conventional material known in the industry to trap small dirt particles while allowing air to pass through the filter. Filter bags are commonly used and can be of different sizes consistent with the design and location of the discharge container. For example, the discharge container may be installed in a wall of a home to be accessible for removing accumulated dirt and debris, as well as discharged cleaning fluids, with a carpet cleaning system.

In summary, the invention includes, but is not limited to, a cleaning system comprising an article having a textile fabric surface covering as a wearing suface. The surface covering has a pile and a primary backing which is made to allow dirt and debris to be carried by air flowing down through the surface covering. A vacuum mat having a secondary backing and formed with the surface covering provides a means for enhancing the air flow with dirt and debris down through the surface covering. The cleaning system also comprises a support platform having a plurality of parallel elongated tubular components for receiving dirt and debris drawn down through the vacuum mat along their length so that dirt and debris is made to flow to coextending ends of the plurality of tubular components. The support platform has a collection device to receive the flow of air with dirt and debris from the ends of said tubular components. A vacuum unit is included for pulling the air with dirt and debris from the collection device through a vacuum line. A discharge container receives the flow of air from the vacuum unit and filters dirt and debris from said air flow before discharging the air to the atmosphere, wherein the article is cleaned.

DESCRIPTION OF THE DRAWINGS

The structure designed to carry out the function of the invention will hereinafter be described together with the features thereof. The invention will be more readily understood from reading the summary and the detailed embodiments of the invention and by reference to the accompanying drawings forming a part thereof, wherein an example of the invention is shown.

FIG. 4A is a schematic cross-section taken along line A—A in FIG. 4A.

DESCRIPTION OF THE PREFERRED EMBODIMENTS

Referring now in more detail to the drawings, the invention will be described in detail to include a best mode for one application of the invention. The invention has many applications and uses as described herein.

Figure 1A:
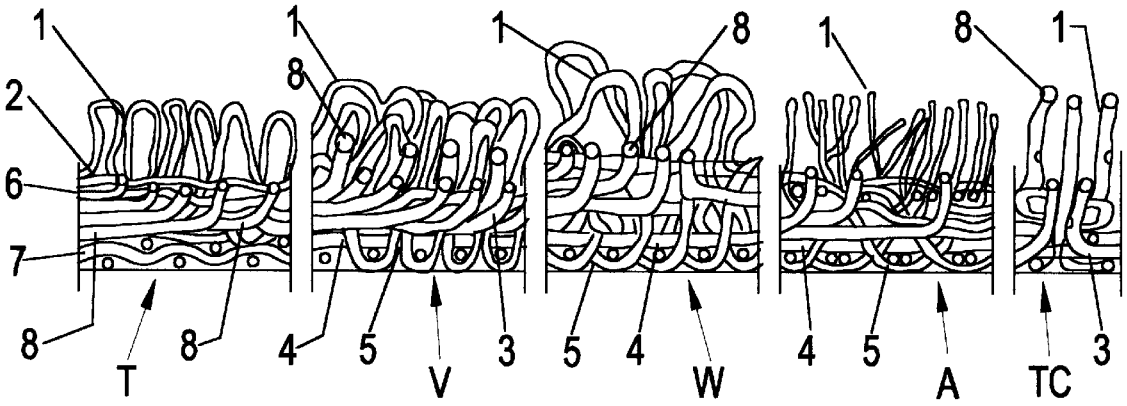
FIG. 1A is a cross-sectional view of different carpets each with a different weave having a pile and a backing formed to provide a vacuum mat made integrally with the carpet.

FIG. 1A illustrates the use of the invention with an article, such as a carpet. The following discussion will refer to carpets without limiting the use of the invention to carpets. Any article made with textile fabrics forming a thick pile wearing surface and an underlying base is also included. In a first embodiment of this invention a carpet is made with tubular elements 3 and 8 incorporated within the carpet when it is made. There are four typical types of carpet weaves schematically illustrated to represent tufting T, velvet V, wilton W and axminster A. The top part of the carpet is the carpet pile 1 affixed to a primary backing 2. The carpet of this embodiment includes a plurality of tubular components or tubes located within the carpet by being inserted during the tufting process beneath the pile. A secondary backing 7 is provided when required to contain the tubular elements. The tubular components are interwoven within the structure of the backing of the carpet and include both outer tubing 8, and inner tubing 3 components in some applications. The primary backing 2 may have a secondary backing 7 to allow space for the tubular components to be included as a part of the carpet. Other standard components of the carpet s illustrated in FIG. 1A include the weft cords 4 and the chain wrap cords 5. This substructure of the carpet is referred to herein as a vacuum mat. In this embodiment of the invention the tubular components can be made to look like the carpet pile and backing itself. In fact, the tubular components can be knotted together or woven to serve as a tubular carpet TC as illustrated in FIG. 1A.

Figure 1B:
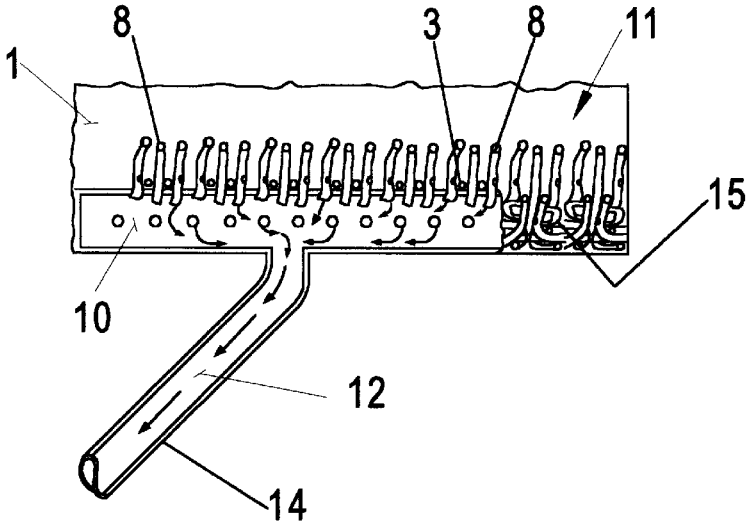
FIG. 1B is a cross sectional view of a various components of a cleaning system for a carpet including a channel and a collection chamber for drawing laden air from the fabric covering of an article.

Tubular components 3 and 8 within the vacuum mat of this embodiment for a carpet have openings into tubular cavities along their length for pulling dirt and debris down through the carpet. The tubular components provide a means for transporting dirt and debris from the carpet being cleaned. However, due to friction within the tubular components, they must discharge into a larger tube or channel for collecting all the dirt and debris together. A plurality of channels 10 are provided to each receive the dirt and debris from a number of tubular elements 3 and 8 as illustrated in FIG. 1B. The channel is evacuated of dirt and debris by providing a vacuum chamber 12 within a collection device 14. The dirt and debris flows from the vacuum chamber through a vacuum unit into a discharge container. The discharge container has a filter for trapping the dirt and debris before exhausting relatively clean air.

Figure 1C:
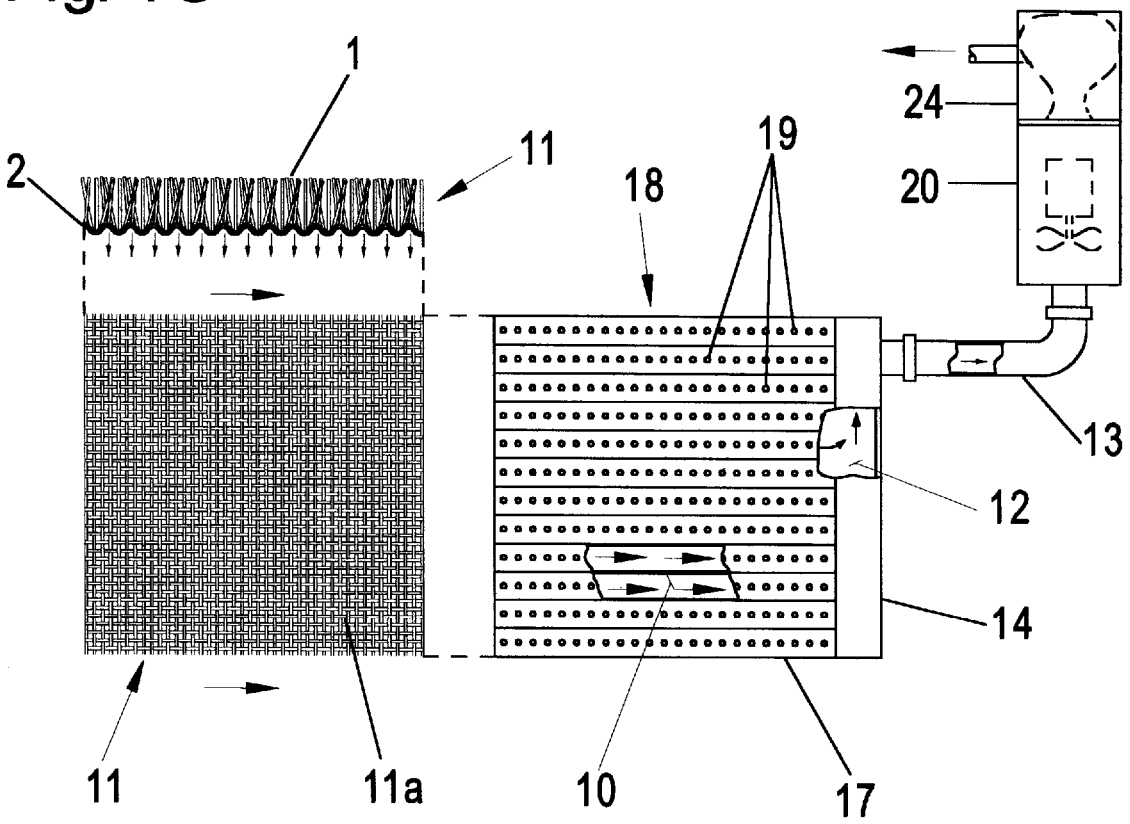
FIG. 1C is a top view of the cleaning system showing a support platform comprising tubular components to be placed under a woven vacuum mat of a carpet and connected by a vacuum line to a vacuum unit and discharge container.

In another embodiment of the invention the vacuum mat 11 is simply formed by the primary backing 2 of the carpet being loosely woven to provide openings through the backing, as illustrated in FIG. 1C. Dirt and debris can pass down through openings 2*a* in the backing from the pile 1 of the carpet as illustrated by the arrows coming from the cross-sectional view of the carpet. The carpet is placed over a support platform 18 having a plurality of openings 19. Openings in the support platform lead to a series of channels 10 formed within the support platform. Openings in the vacuum mat are generally aligned with the openings in the support platform to receive dirt and debris from the carpet. The channels lead into a vacuum chamber 12 of a collection device 14 of the support platform being along one side of the support platform 18. The dirt and debris is drawn from the collection device through a vacuum line 13 into a vacuum unit 20. The vacuum unit discharges the dirt and debris to a discharge container 24 to be filtered and clean air discharged to the atmosphere. The size of the cleaning system of FIG. 1C is made to conform to the size of the article being cleaned. The support platform 18 is made to look like the article and the vacuum unit along with the discharge container is normally hidden from view.

Figure 2A:
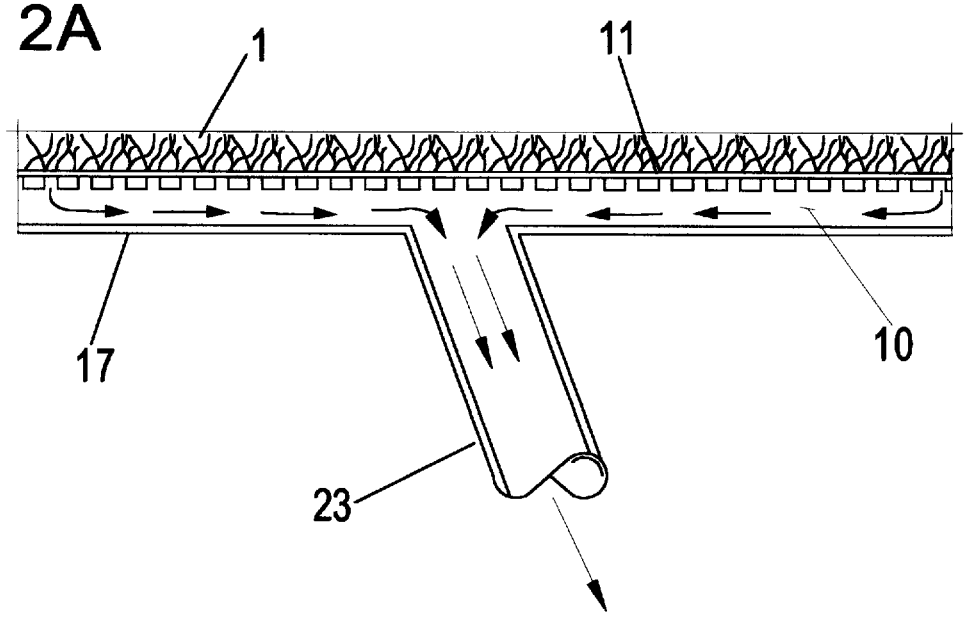
FIG. 2A is a cross-sectional view of a carpet with a support frame having an drain outlet for discharging dirt and debris, or a cleaning fluid, from the cleaned carpet.
Figure 2B:
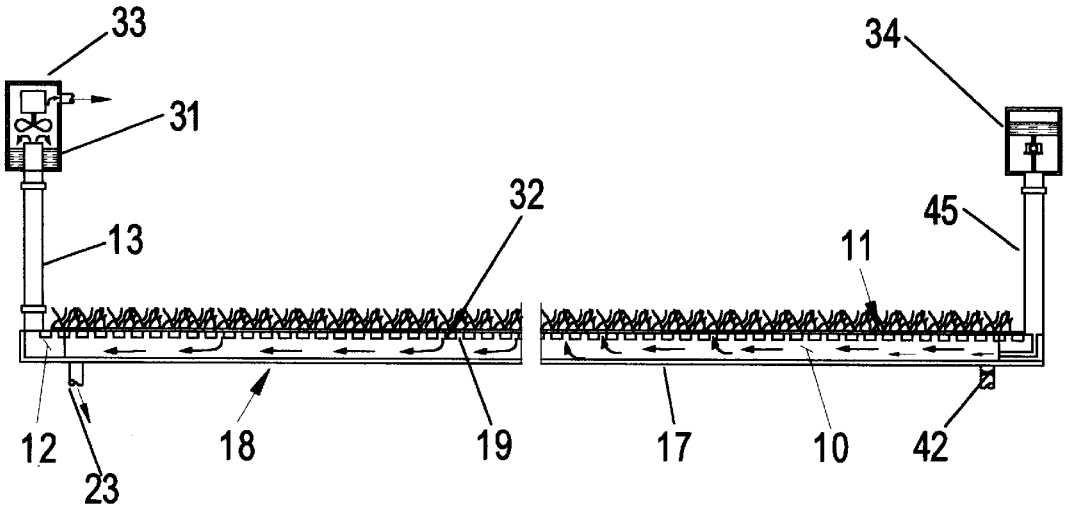
FIG. 2B is a cross-sectional view of the cleaning system showing the flow of cleaning fluids or water from a cleaning unit into the carpet through a vacuum chamber on the right and removal of soiled cleaning fluids or water transported to a drain and a wet vacuum unit on the left, being two fuctions of the vacuum cleaning system.
Figure 2C:
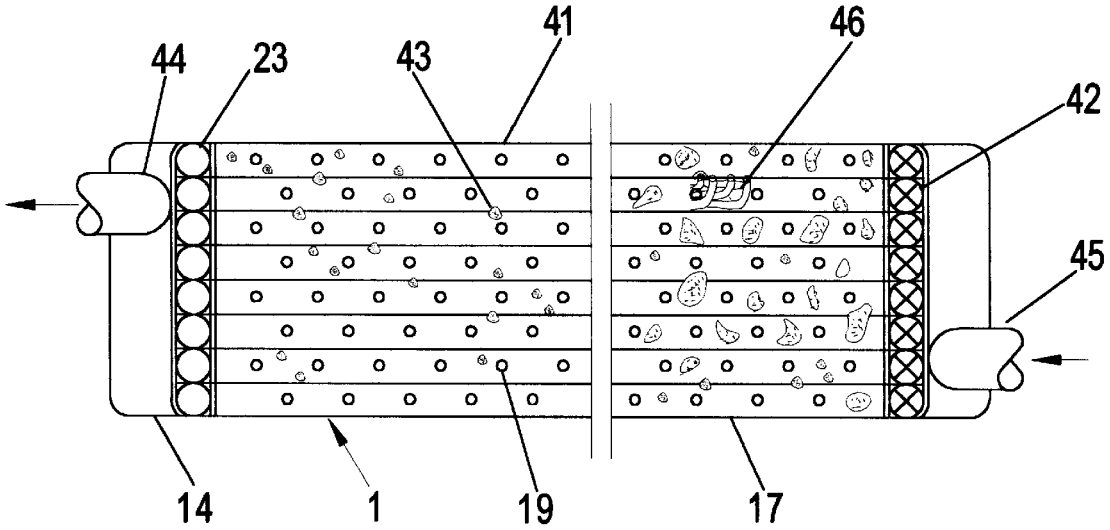
FIG. 2C is a plan view of a support platform showing openings in the tubular components for forcing a cleaning fluid into the carpet on the right and for draining soiled receiving dirt and debris particles from a carpet being cleaned on the left; including a drain system for removal of cleaning fluids.

Further embodiments of the cleaning system of this invention includes the addition of a cleaning unit and a drain system. A cleaning unit can help clean the article by forcing a cleaning fluid or water into the article to be removed after the article is allowed to become clean. A heating element can also be added within the cleaning unit for steam cleaning the article. The cleaning unit 34 uses the same components of the support platform, as illustrated in FIGS. 2A–2C. In FIG. 2B the left side of the cross-sectional view shows a cleaning fluid or water being forced into the carpet 46 by the cleaning unit 34 through cleaning line 45. Channel 10 of the tubular component 17 of the support platform 18 transports the cleaning fluid or water into the carpet 46, as illustrated in FIGS. 2B and 2C. The right side of the cross-sectional view of FIG. 2B show the cleaning fluid or water being drawn from the carpet 32 by the wet vacuum unit 33 through the vacuum line 13. The discharge container 31 retains the soiled fluid or water for disposal. A drain 23 is also provided for assisting the vacuum unit in removing the soiled cleaning fluid or water, as illustrated in FIGS. 2A–2C. A drain valve 42 must be used for closing the drain when the cleaning fluid or water is being forced into the carpet 46. A single drain from the vacuum chamber 12 is preferred when possible in lieu of drains from each tubular component 17. It is not necessary to have a separate cleaning line 45 as the vacuum line 13 can be used as a cleaning line when the cleaning unit is attached to the vacuum line.

Figure 3A:
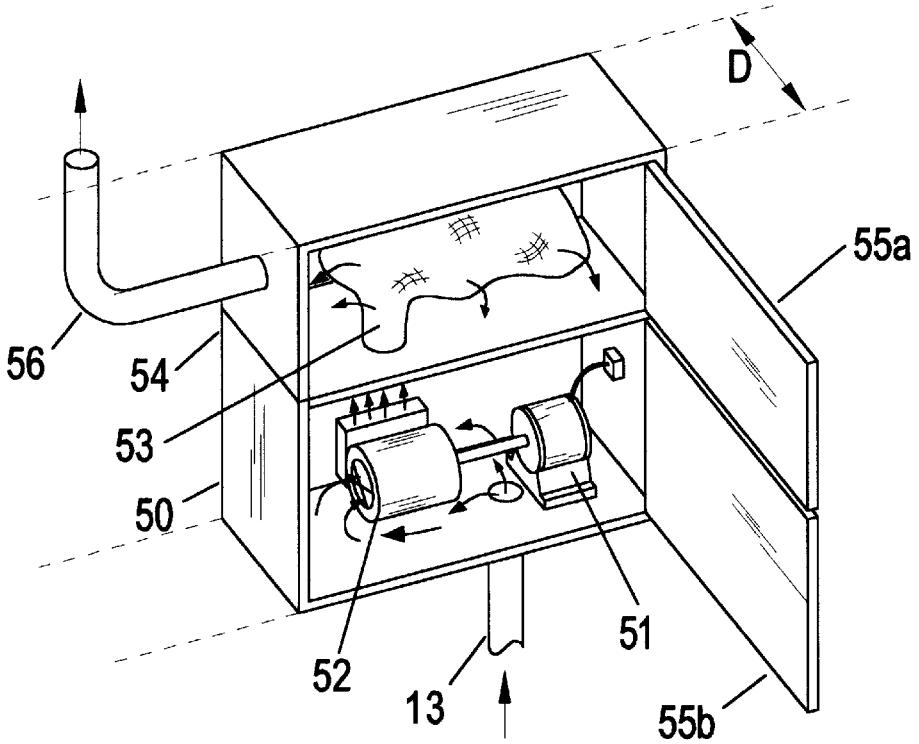
FIG. 3A is a simplified perspective view of a vacuum unit and a discharge container mounted in a wall, and showing the flow of dirt and debris through these components of the cleaning system's vacuum unit.

The location of the vacuum unit and the discharge container are critical to providing a cleaning system. The object is to make the cleaning system of this invention self supporting so that the article can be cleaned by simply turning on a switch. The vacuum unit 54 and the discharge container of FIG. 3A are placed within the depth D of a wall, or the like. At least one door is provided to access components within the unit and the container. Preferably a filter door 55*a* allows access to the air bag 53 and a fan door 55*b* allows access to the fan 52 and motor 51. When the doors are closed they are generally flush with the wall surface. Dirt and debris is pulled into the vacuum unit through the vacuum line 13 and discharged into the air bag by the fan. A high powered fan 52 is preferred to allow a large surface area of the article to be cleaned. Cleaned air is discharged through the discharge line 56 using the depth of the wall.

Figure 3B:
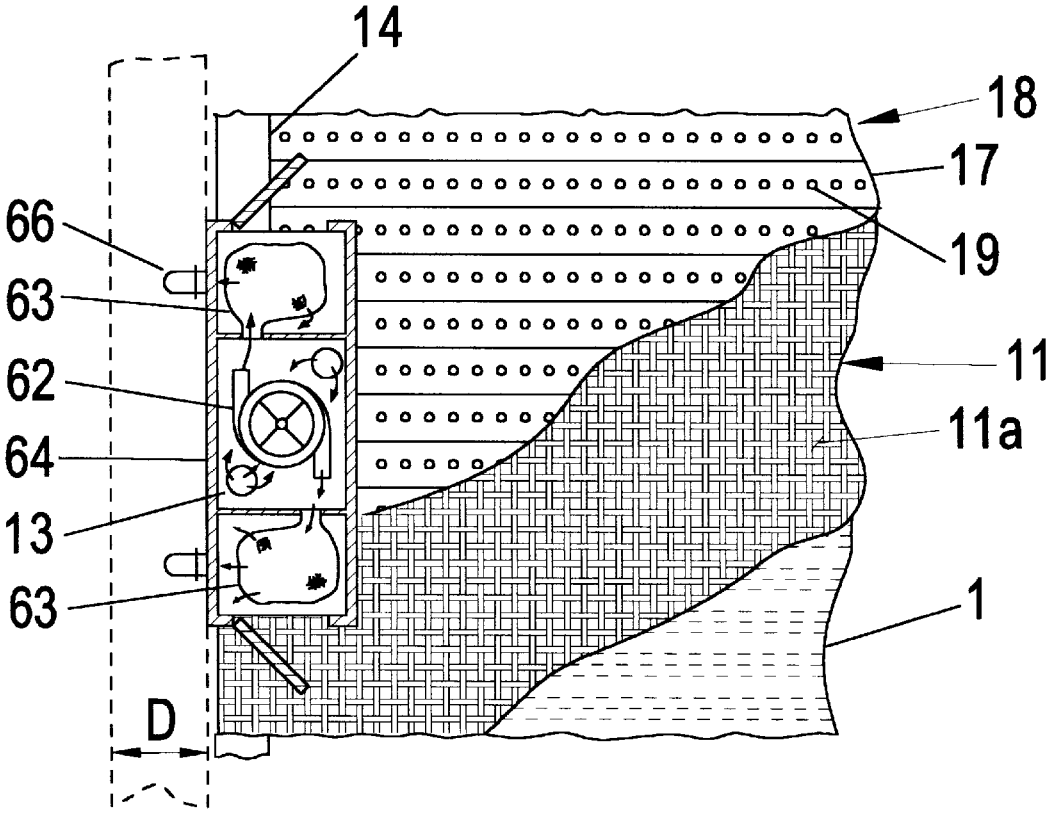
FIG. 3B is a plan view of a vacuum unit placed in a wall of a building to interface with a vacuum mat of a carpet.
Figure 3C:
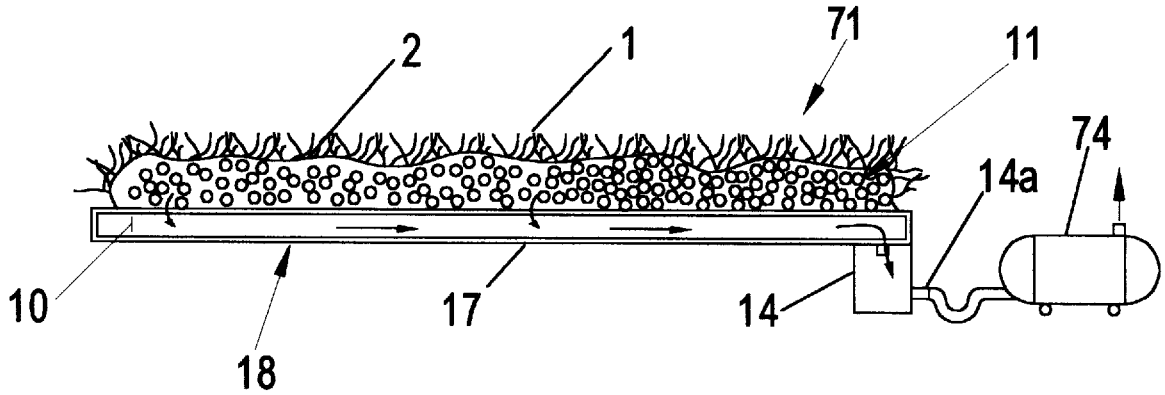
FIG. 3C is a cross-sectional view of a upholstered cushion having a support platform form with the cushion for drawing dirt and debris into a vacuum chamber when suction is applied to the chamber to clean the cushion.

In another embodiment the vacuum unit 64 can be attached to the wall surface, and the like, having a depth D as illustrated in FIG. 3B. A cross-sectional view of the preferred vacuum unit is illustrated showing the other components in a break away plan view below the vacuum unit. For example, a carpet having a carpet pile 1 is placed over a vacuum mat 11 which is placed over the support platform 18. Dirt and debris is pulled from the pile down through the openings 11*a* in the vacuum mat through the holes 19 in the tubular components 17 of the support platform when the fan 62 is activated to provide a suction. The collection device 14 receives the dirt and debris to be transferred through the vacuum line 13 into the vacuum unit 64. Two air bags 63 are provided in this embodiment to maintain a low profile from the wall surface. Two discharge lines 63 are placed to an interior to the wall for evacuating the clean air from the system. A pair if doors are also provided for the accessing the air bags.

In another embodiment of the invention the cleaning system is used for a cushion of upholstered furniture. The pile 1 of the fabric covering is made with a primary backing 2 having openings for the flow of dirt and debris from the pile to the vacuum mat 11. For this application the vacuum mat is made with a plurality of tubular components to assist in removing dirt and debris from the cushion. The vacuum mat is made to be integral with the pile 1 and primary backing 2 of the fabric covering (FIG. 1B). A typical support platform 18 having a plurality of tubular components 17 with internal channels 10 collect the dirt and debris and discharge it into a collection device 14. Suction is provided by a portable vacuum unit 74 having internal air bags for cleaning the air of dirt and debris. A vacuum chamber nozzle 14*a* is provided for attaching a flexible hose of the vacuum unit.

Figure 4A:
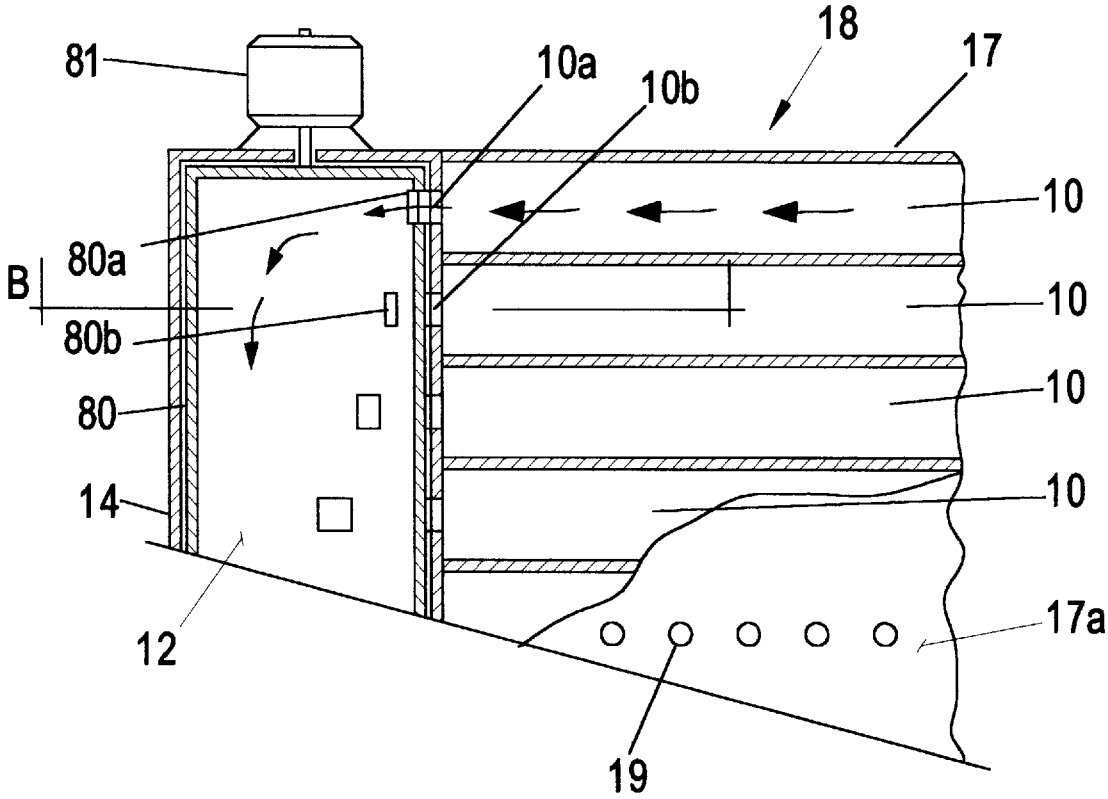
FIG. 4A is a schematic cross-section showing a sliding component within a support platform to selectively align openings in the platform to maintain suction in selected portions of the cleaning system.
Figure 4B:
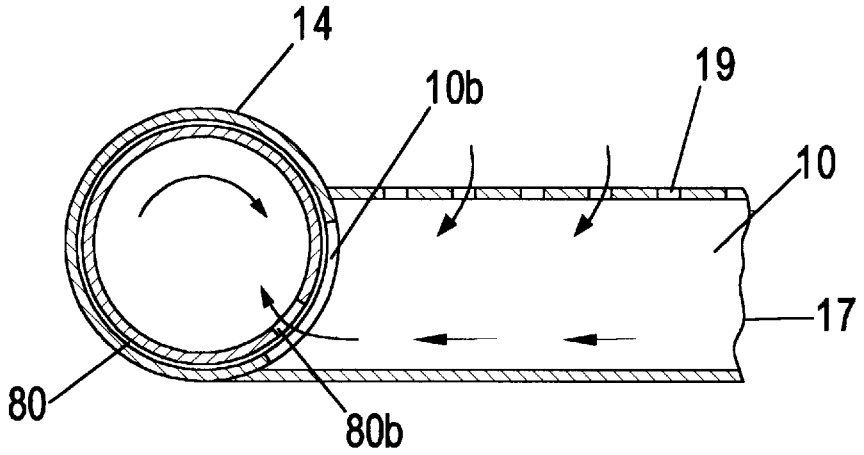

For cleaning large areas with the cleaning system of this invention a means to maintain the proper suction through the article is provided. A cross-sectional view of a support platform 18 is illustrated in FIGS. 4A and 4B. The typical components include tubular components 17 forming channels 10 for transporting dirt and debris into the vacuum chamber 12 of the collection device 14. A cover plate 17*a* of the platform has openings 19 to receive dirt and debris from the article being cleaned. An additional component is added to the interior of the collection device to provide a means to selectively draw dirt and debris from only certain channels 10. A sliding portion 80 of said support platform is made to rotate within the collection device 14. For example, openings 80*a* and 80*b* in the sliding device can be positioned to correspond with openings 10*a* and 10*b* coming from the channels 10. By rotating the sliding device the channels are sequentially made to open into the vacuum chamber 12. In this way suction can be maintained for the article. A motor 81 is shown to rotate the slider device, however the slider device can be moved by hand. Other types and arrangements of slider devices are within the scope of this invention to maintain adequate suction. A simple valve arrangement in the openings from the channels 10 is also a possible embodiment.

The sliding component may include an agitator for vibrating the cleaning system to enhance the movement of dirt and debris carried by the flow of air. An agitator unit may also be a separate component within the scope of this invention.

Figure 5:
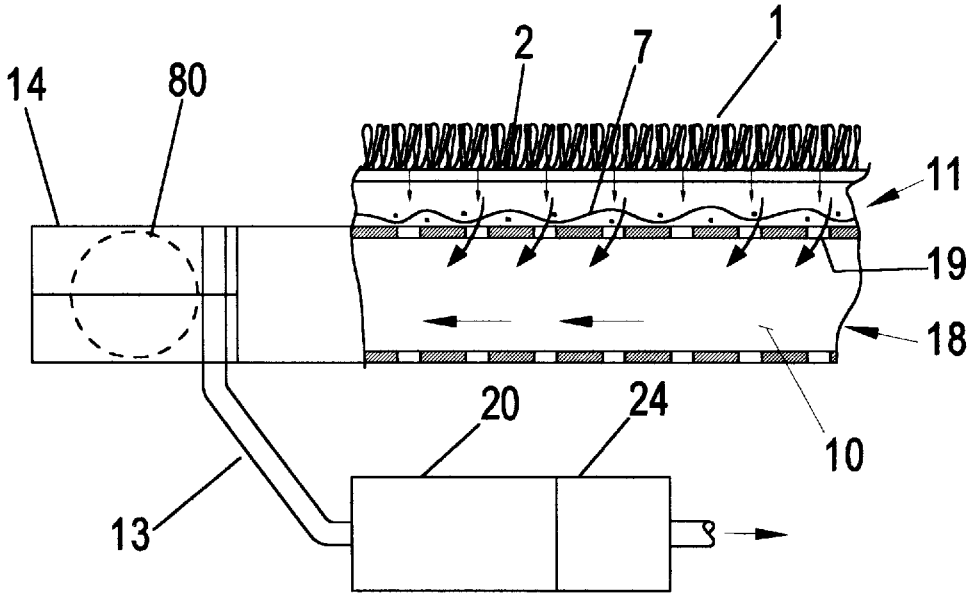
FIG. 5 is a schematic of the preferred components of a best mode cleaning system of the invention.

The essential cleaning system components for a best mode are illustrated in FIG. 5. The textile fabric covering of an article has a pile 1 and a backing 2. A vacuum mat 11 is added below the fabric covering to aid in the flow of dirt and debris from the pile 1 of the covering. The vacuum mat has a secondary backing 7 to further support the components within the vacuum mat. A support platform 18 below the vacuum mat receives the dirt and debris through openings 19 of the support platform. The dirt and debris is transported through channels 10 in the support platform to a collection device 14. The collection device is equipped with a slider device 80 within the collection device for maintaining adequate suction in the cleaning system. The vacuum unit 20 pulls dirt and debris from the collection device through the vacuum line 13 and discharges it into the discharge container 24. After cleaning the dirt and debris from the air it is discharged to the atmosphere.

From the foregoing description, it is believed that those familiar with the art will readily recognize and appreciate the novel concepts and features of the present invention. Obviously, while the invention has been described in relation to a limited number of embodiments, numerous further variations, changes, substitutions and equivalents will present themselves to persons skilled in the art and may be made without necessarily departing from the scope and principles of the invention, with the latter being determined solely by reference to the claims appended hereto.

What is claimed is:

1. A cleaning system for use with an article having a textile fabric surface covering, said system comprising:

a vacuum mat placed under said surface covering over an area to be cleaned, said vacuum mat having a plurality of openings for providing a means for dirt and debris carried by a flow of air from said surface covering to pass through said vacuum mat;

A support platform positioned for supporting said vacuum mat over said area, said support platform having a plurality of channels with openings into each channel to correspond with said plurality of openings in the vacuum mat for receiving said dirt and debris from said vacuum mat; and a vacuum unit for providing said flow of air for sucking said dirt and debris suspended in the air from said support platform for disposal, wherein said article is capable of cleaning itself.

2. The system set forth in claim 1 wherein said vacuum mat includes a plurality or hollow tubes woven into said surface covering to provide said plurality of openings in said vacuum mat.

3. The system set forth in claim 1 wherein said vacuum mat includes a loosely woven web to interface with said surface covering to provide said plurality of openings in said vacuum mat.

4. The system set forth in claim 1 wherein the support platform includes:

a plurality of extending tubular components each having an outlet end, an internal bore forming one of said plurality of channels and a top surface having aperatures for forming said openings into a respective channel; and a collection chamber for terminating said plurality of tubular components at said outlet ends so that said dirt and debris suspended in the air is collected in a vacuum chamber within said collection chamber.

5. The system set forth in claim 4 including a vacuum line extending from said collection chamber to said vacuum unit for locating the vacuum unit at a remote location from the collection device of the support platform.

6. The system set forth in claim 4 wherein said vacuum unit includes a fan driven by an electrical motor when said motor is activated for establishing a vacuum within said collection chamber for evacuating dirt and debris from said collection chamber of said support platform.

7. The system set forth in claim 6 including a wall of a building wherein said vacuum unit is mounted within said wall for providing a vacuum system built into the building.

8. The system set forth in claim 6 including a wall of a building wherein said vacuum unit is mounted on a surface of said wall for making a vacuum system built into the building.

9. The system set forth in claim 1 including a discharge container to receive the dirt and debris being discharged from the vacuum unit.

10. The system set forth in claim 9 wherein the discharge container includes an air bag for filtering dirt and debris from the laden air for discharging clean air to the atmosphere.

11. The system set forth in claim 1 including a cleaning unit having a pump for forcing a cleaning fluid into said channels of said support platform and further forcing said cleaning fluid into said article for cleaning said article.

12. A cleaning system for use with an carpet having a textile fabric pile and primary backing, said system comprising:

a vacuum mat placed under said carpet over an area to be cleaned, said vacuum mat having a plurality of openings for providing a means for dirt and debris carried by a flow of air from said carpet to pass through said vacuum mat;

a support platform positioned under said vacuum mat over said area, said support platform having a plurality of channels with openings into each channel to generally correspond with said plurality of openings in the vacuum mat for receiving said dirt and debris carried by the air from said vacuum mat; and a vacuum unit for sucking said dirt and debris suspended in the air from said support platform for disposal, wherein said carpet is capable of cleaning itself.

13. The system set forth in claim 12 wherein the support platform includes:

a plurality of extending tubular components each having an outlet end, an internal bore forming one of said plurality of channels and a top surface having aperatures for forming said openings into a respective channel; and a collection chamber for terminating at one edge of said area said plurality of tubular components at said outlet ends so that said dirt and debris suspended in the air is collected in a vacuum chamber within said said collection chamber.

14. The system set forth in claim 13 including a slider device located within said collection chamber of said support platform for allowing dirt and debris laden air to flow into said collection chamber from only selected tubular components at a time for maintaining an adequate flow provided by said vacuum unit.

15. The system set forth in claim 12 including a discharge container to receive the dirt and debris being discharged from the vacuum unit.

16. The system set forth in claim 15 wherein the discharge container includes an air bag for filtering dirt and debris from the air before discharging said air to the atmosphere.

17. The system set forth in claim 16 including a heating element included within said cleaning unit for steam cleaning said carpet.

18. The system set forth in claim 12 including a cleaning unit having a pump for forcing a cleaning fluid into said channels of said support platform and further forcing said cleaning fluid into said carpet for cleaning said carpet.

19. A cleaning system comprising;

an article having a textile fabric surface covering as a wearing suface, said surface covering having a pile and a primary backing which is made to allow dirt and debris to be carried by air flowing down through the surface covering;

a vacuum mat having a secondary backing and formed with the surface covering for providing a means for enhancing the air flow with dirt and debris down through the surface covering;

a support platform having a plurality of parallel elongated tubular components for receiving dirt and debris drawn down through the vacuum mat along their length so that dirt and debris is made to flow to coextending ends of said plurality of tubular components;

said support platform having a collection device to receive the flow of air with dirt and debris from said ends of said tubular components;

a vacuum unit for pulling the air with dirt and debris from the collection device through a vacuum line; and a discharge container for receiving the flow of air from said vacuum unit and filtering dirt and debris from said air flow and discharging the air to the atmosphere, wherein said article is cleaned.

20. The cleaning system set forth in claim 19 including a slider device located within said support platform for allowing dirt and debris laden air to flow into said collection device from only selected tubular components at a time for maintaining an adequate flow of laden air provided by said vacuum unit, said slider device also comprising a agitator for vibrating the cleaning system.

* * * * *